US006297454B1

(12) United States Patent
Gareis

(10) Patent No.: US 6,297,454 B1
(45) Date of Patent: Oct. 2, 2001

(54) CABLE SEPARATOR SPLINE

(75) Inventor: Galen M. Gareis, Richmond, IN (US)

(73) Assignee: Belden Wire & Cable Company

( * ) Notice: Subject to any disclaimer, the term of this patent is extended or adjusted under 35 U.S.C. 154(b) by 0 days.

(21) Appl. No.: 09/452,702

(22) Filed: Dec. 2, 1999

(51) Int. Cl.[7] ..... H01B 7/00
(52) U.S. Cl. ..... 174/113 C
(58) Field of Search ..... 174/110 R, 113 R, 174/113 C, 120 R, 113 AS

(56) References Cited

U.S. PATENT DOCUMENTS

| | | | | |
|---|---|---|---|---|
| 514,925 | * | 2/1894 | Guilleaume . | |
| 3,819,443 | * | 6/1974 | Simons et al. | 156/204 |
| 5,132,488 | * | 7/1992 | Tessier et al. | 174/34 |
| 5,444,184 | * | 8/1995 | Hassel | 174/113 R |
| 5,789,711 | * | 8/1998 | Gaeris et al. | 174/113 C |
| 5,952,615 | * | 9/1999 | Prudhon | 174/113 C |
| 5,969,295 | * | 10/1999 | Boucino et al. | 174/113 R |

FOREIGN PATENT DOCUMENTS

404332406A * 11/1992 (JP) .

* cited by examiner

*Primary Examiner*—Dean A. Reichard
*Assistant Examiner*—William H. Mayo, III
(74) *Attorney, Agent, or Firm*—Robert F. I. Conte; Lee, Mann, Smith, McWilliams, Sweeney & Ohlson

(57) ABSTRACT

A cable separator spline and a cable containing the cable separator spline in its core. The spline extends longitudinally and has a plurality of spaced longitudinally extending open pockets in which cables, such as twisted pair cables, can be placed and form part of the core. A cross-section of the spline has a major axis and a minor axis with the major axis being longer than the minor axis. At least one and preferably at least two pockets are on the major axis, and at least one and preferably at least two pockets are on the minor axis. The core containing the twisted pair cables in the pockets can of course be shielded and jacketed, just jacketed or any other desired cable construction that would benefit from the use of my elongated separator spline.

22 Claims, 2 Drawing Sheets

CABLE SEPARATOR SPLINE

FIELD OF THE INVENTION

The present invention relates to a separator filler or spline. More particularly the present invention relates to the separator filler or spline having four pockets with each pocket having a cross-sectional area that is less than the envelope area of a pair of cables adapted to be placed in each pocket.

BACKGROUND OF THE INVENTION

The most popular separator fillers or splines are generally based on a circular cross-section wherein each pocket generally has a cross-sectional area that is greater than the cross-sectional envelope area of the twisted pair cable that is to be placed in the pocket. This type of spline generally has less flexibility and undesirable to skew degradation.

SUMMARY OF THE INVENTION

The oval envelope provided by my spline has an acceptable NEXT performance and good flexibility. Therefore, it is an object of the present invention to provide a cable separator filler or spline having a plurality and preferably four opened pockets for separating a plurality of cable pairs, preferably one cable pair for each pocket. Preferably when there are an even number of pockets, the pockets are diametrically opposite each other. When there are four pockets, the first and second pockets are diametrically opposite each other and third and fourth pockets are diametrically opposite each other. In a cross-sectional plane of the spline the diametric distance between the ends of the first and second pockets is greater than the diametric distance of the ends of the group of the third and fourth pockets to provide an oval envelope for the spline. All of the pockets have a cross-sectional area that is less than the envelope cross-sectional area of the cable pair that is to be placed in the respective pockets. The longitudinal axis of each of the pockets are all substantially parallel to each other.

A cable manufactured using the spline of my invention generally uses an oval envelope spline having four pockets and has a twisted pair cable in each pocket. The long lay twisted pair cables are both preferably in the pockets on the major axis of the oval envelope. The short lay twisted pair cables are both in the pockets on the minor axis of the oval envelope. In this embodiment the core components are comprised of the elongated separator spline and the four twisted pair cables. The core can of course be shielded and jacketed, just jacketed or any other desired cable construction that would benefit from the use of my elongated separator spline.

With my elongated separator spline long and short lay twisted pairs can be ideally placed for maximum electrical advantages. Short lay pairs, which have the best flexibility can be placed across the minor axis of the separator spline. Short lays typically have improved NEXT and the close proximity to one another does little to worsen NEXT. The long lay pairs can be placed across the major axis where bending strain is minimized. This overall cable design will bend across the minor axis based on the fact that the "column" will collapse across its minimum integral bending moment axis. The use of my elongated separator spline also improves skew over a similar round design because two unique cabling lay factors are in practice when the twisted pairs are cabled (minor and major axis). This helps compensate for the pair lengths between the long and short lay pairs equalizing the final conductor lengths which also tends to improve attenuation delta from the minimum lay pair to the maximum lay pair. My spline may be "metalized", or coated with any form of metallic material that will preserve its exterior shape, and substantially improve NEXT while still enhancing the attenuation delta and skew of pairs.

Generally alien NEXT is minimized since the cables "oval" will provide air spacing between parallel cables of any other type. Also there are economies in my spline over the generally used cylindrical splines in that less filler material generally is used in my elongated separator spline than in a round design for equal performance.

The present invention and the advantages thereof will become more apparent upon consideration of the following detailed description when taken in conjunction with the accompanying drawings.

DETAILED DESCRIPTION

The following description taken in conjunction with the drawings will further explain the inventive features of my elongated separator spline and cables utilizing my elongated separator spline.

Figure 1:
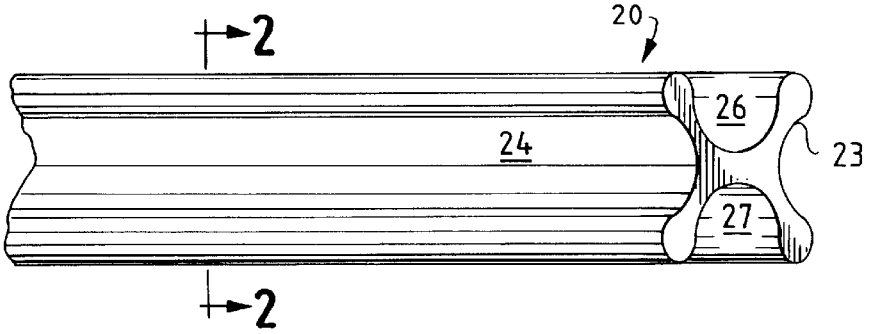
FIG. 1 is a perspective view of the elongated separator spline of my invention.
Figure 2:
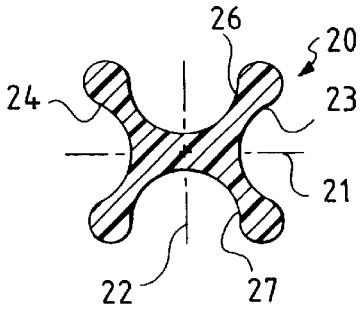
FIG. 2 is a cross-sectional view taken along lines 2—2 of FIG. 1.
Figure 3:
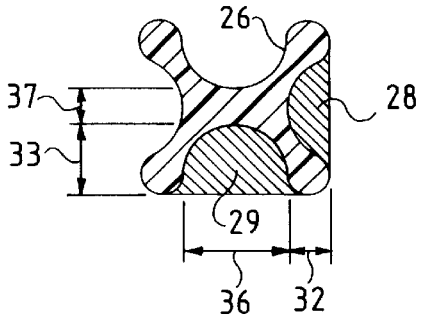
FIG. 3 is the same as FIG. 2 except having a shaded portion to define a cross-sectional area.

Referring to FIGS. 1 and 2, my elongated separator spline 20 has along its cross-sectional plane a major axis 21 and a minor axis 22. In the preferred embodiment, the minor axis 22 is perpendicular to the major axis 21. The preferred elongated separator spline 20 is shown with four cable pockets 23, 24, 26, and 27. Other oval configurations could have more all less pockets. The pockets 23 and 24 are on the major axis 21 and pockets 27 and 26 are on the minor axis 22. In a preferred embodiment, pockets 23 and 24 have the same cross-sectional area as each other and pockets 26 and 27 have the same cross-sectional area as each other. If desired, they can all have the same cross-sectional area. The cross-sectional area of the pockets as shown in FIG. 3. These are indicated by the shaded areas 28 and 29.

Figure 4:
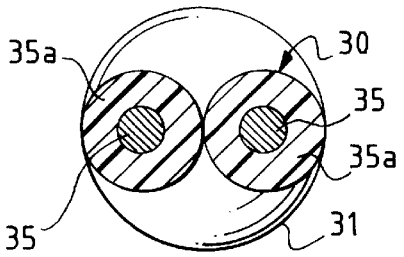
FIG. 4 is a cross-section of a twisted pair cable to be used with the spline of FIG. 1.

FIG. 4 illustrates a cross-section of a twisted pair cable 30 having a pair of conductors 35 with appropriate insulation 35(*a*). The cable 30 has a circular envelope 31. The cross-sectional area of the twisted pair circular envelope 31 is greater than the cross-sectional area of any of the pockets.

Each of the pockets 23 and 24 have a depth 32 and each of the pockets 26 and 27 have a depth 33. The depths 32 and 33 of the pockets is less than the diameter 34 of the twisted pair envelope 31. The cross-sectional depth 32 of the pockets 23 and 24 is less than the cross-sectional depth 33 of the pockets 26 and 27. In a preferred embodiment, each of the cross-sectional areas 28 and 29 is 25% to 75% of the cross-sectional area of the envelope 31. The preferred elongated separator spline 20 has four longitudinally extending pockets 23, 24, 26 and 27 of two different sizes. However, if it is desired, the sizes of the pocket can all be different depending upon the size of the cables that are to be placed in the pockets. The size of the pockets will scale up or down based on the size of the cable, i.e., 30 (FIG. 4) to be placed in the pocket. If desired, the pockets may even have a depth which is greater than the diameter of the cable pair envelope. The present embodiment's major axis 21, when measured from the inside bases of the pockets 23 and 24, has a length 36 of 0.050 in. to about 0.100 in. The minor axis, when measured from the inside bases of the pockets 26 and 27, has a length 37 of about 0.010 in. to about 0.030 in. The preferred material for the elongated separator spline is any suitable solid or foamed polymer or copolymer depending on the needs of the user for crush resistance, breaking strength, gel fillings, safety, and the need for flame and smoke resistance. In many applications the material will be a polyethylene.

Figure 5:
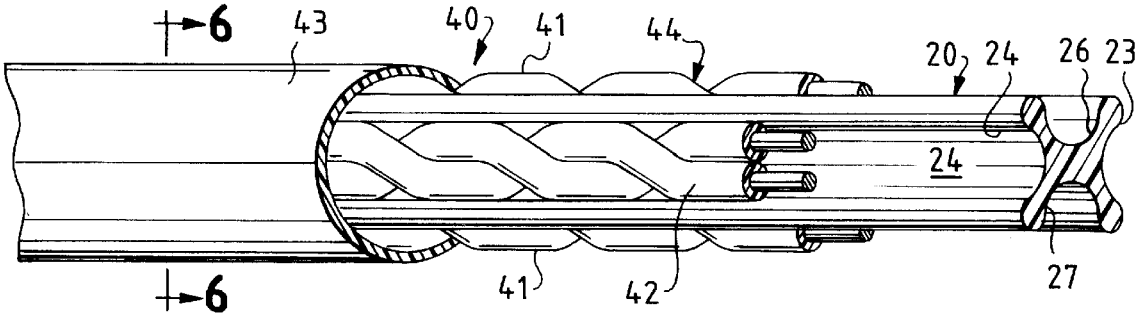
FIG. 5 is perspective view of a cable utilizing my elongated separator spline.
Figure 6:
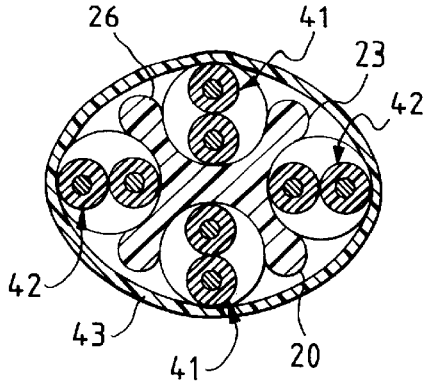
FIG. 6 is a cross-section view taken along lines 6—6 of FIG. 5.

Referring to FIGS. 5 and 6, there is shown a cable 40, having as its core 44 my elongated separator spline 20 with major axis pockets 23 and 24 each containing a twisted pair cable 42 having a long lay of about 0.5 in. to about 1.5 in. and with minor axis pockets 26 and 27 each containing a twisted pair cable 41 having a short lay of about 0.25 in. to about 0.75 in. The core which contains the elongated separator spline 20 and the cables 41 and 42 in the pockets as shown in FIGS. 5 and 6, is surrounded by a jacket 43 which was extruded thereover. The jacket 43 can be any suitable jacket material normally utilized such as anyone of the following which also may be foamed on non-foamed i.e. polyvinyl chloride, fluorinated polymers, polyethylene, the flame retardant compositions, etc. The twisted pair cables 41 and 42 are the same construction as the twisted pair cable 30.

Figure 7:
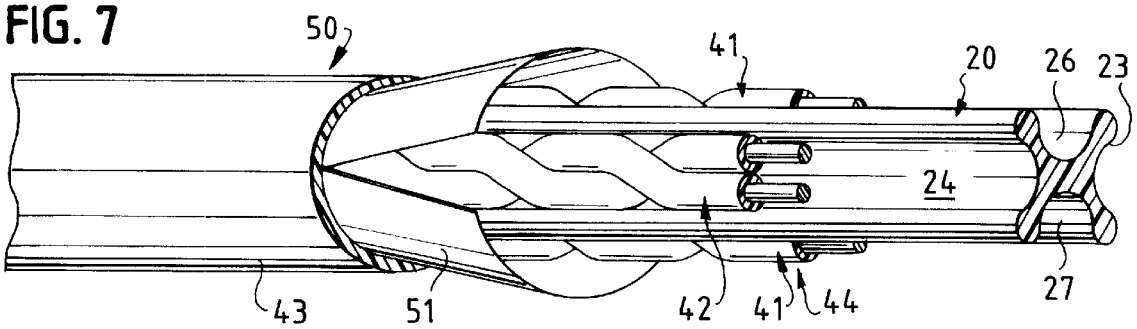
FIG. 7 is a perspective view of another cable utilizing my elongated separator spline.

Referring to FIG. 7 there is shown a cable 50 having the same construction as the cable 40 except it has shield 51 wrapped around the core 44. The shield 51 may be any suitable shield such as an aluminum tape, BELDFOIL, DUOFOIL, or any suitable metal tape. The shield 51 is generally laterally wrapped around the core 44 and then the jacket 43 is extruded around the shield. Although the shield is shown as a lateral wrapped tape, it can be a helically wound tape. A drain wire (not shown ) can be inserted into the cable 50 if desired.

Figure 8:
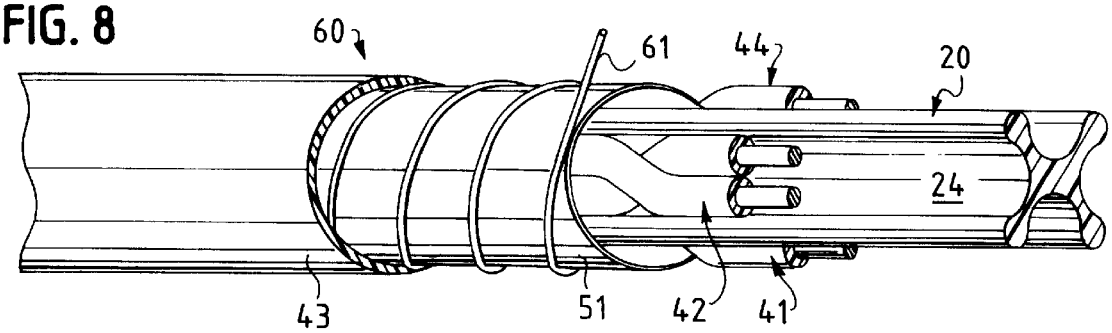
FIG. 8 is a perspective view of still another cable utilizing my elongated separator spline.

Referring to FIG. 8, there is shown a cable 60 using a drain wire 61. The cable 60 has the same construction as the cable 50 except in this embodiment of the drain wire 61 is helically wrapped around the lateral shield 51 for the dual purpose of being a drain wire and to hold the lateral shield 51 in place. The jacket 43 is then extruded over the shield 51 and drain wire 61.

Figure 9:
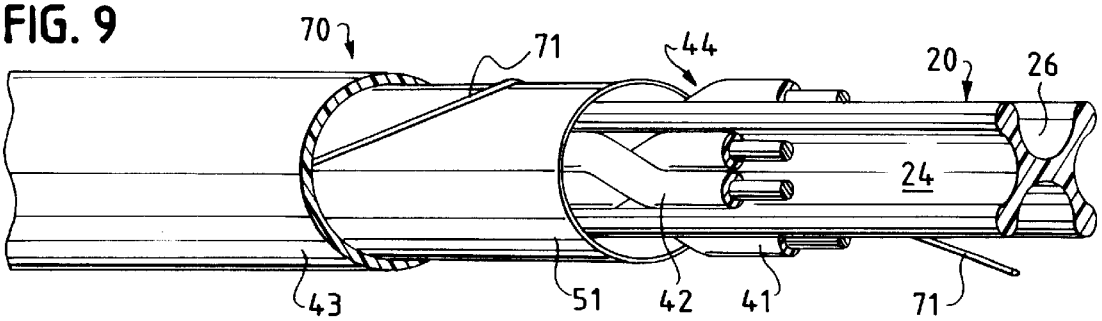
FIG. 9 is a perspective view of a further cable utilizing my elongated separator spline.

Referring to FIG. 9, there is shown still another cable 70 having the same construction as the cable 50 except it uses a drain wire 71 having a gentle wrap around the lateral shield 51. The jacket 43 is then extruded over the shield 51 and drain wire 71.

The drain wires 61 and 71 are generally made with tinned copper, tinned aluminum, etc.

The size of the twisted pair cables 41 and 42 are generally about 24 AWG. to about 22 AWG.

The conductors 35 for the twisted pair cables are generally copper, tinned copper, or an appropriate bronze and these are generally insulated with a foamed on non-foamed insulation 35(*a*) of polyethylene, polypropylene, fluorinated ethylene propylene, tetrafluoroethylene, polyvinyl chloride, etc.

Although I have described my elongated spline as having four pockets, the spline may have more or less pockets.

It will, of course, be appreciated that the embodiments which have just been described have been given by way of illustration, and the invention is not limited to the precise embodiments described herein. Various changes and modifications may be effected by one skilled in the art at without departing from the scope or spirit of the invention as defined in the appended claims.

What is claimed is:

1. A communication cable separator spline comprising:

a longitudinally extending spline having a plurality of spaced longitudinally extending open pockets, a cross-section of said spline having a major axis and a minor axis, at least one pocket being on the major axis, at least one pocket being on the minor axis, and each of said pockets have a cross-sectional area which is 75% or less than a cross-sectional area of a circular envelope of an insulated cable to be placed in said pockets.

2. The spline of claim 1 wherein, said major axis is substantially perpendicular to said minor axis, and each of said pockets longitudinally extending substantially parallel to each other.

3. The spline of claim 1 wherein, said spline has first, second, third, and fourth spaced longitudinally extending open pockets, a cross-section of said spline having a major axis and a minor axis, said first and second pockets having substantially the same cross-sectional area, and said third and fourth pockets having substantially the same cross-sectional area.

4. The spline of claim 3 wherein, said major axis is substantially perpendicular to said minor axis, said third and fourth pockets having substantially the same cross-sectional area, and said first, second, third, and fourth pockets longitudinally extending substantially parallel to each other.

5. The spline of claim 4, wherein said first and second pockets having a depth greater than a depth of said third and fourth pockets, and each of said pockets have a cross-sectional area of about 25% to 75% the cross-sectional area of the circular envelope of the cable to be placed in said pockets.

6. A communication cable comprising:

a cable core surrounded by a jacket, said cable core having a longitudinally extending spline having first, second, third, and fourth spaced longitudinally extending open pockets for separating four twisted pair cables, a cross-section of said spline having a major axis and a minor axis, said major axis being substantially perpendicular to said minor axis, said first and second pockets been diametrically spaced from each other and being on the major axis, a first twisted pair cable having a pair of conductors with each conductor having insulation thereon and having a long lay and being in each of said first and second pockets, said third and fourth pockets been diametrically spaced from each other and being on the minor axis, a second twisted pair cable having a pair of conductors with each conductor having insulation thereon and having a short lay and being in each of said third and fourth pockets, said first and second pockets having substantially the same cross-sectional area, said third and fourth pockets having substantially the same cross-sectional area, each of said first, second, third, and fourth pockets longitudinally extending substantially parallel to each other, said first and second pockets having a depth greater than a depth of said third and fourth pockets, and each of said first, second, third, and fourth pockets having a cross-sectional area which is 25% to 75% of the cross-sectional area of a circular envelope of the twisted pair cable in said pockets.

7. A communication cable comprising:

a cable core surrounding by a jacket, said cable core having a longitudinally extending spline having a plurality of spaced longitudinally extending open pockets, a cross section of said spline having a major axis and a minor axis, at least one pocket being on the major axis, at least one pocket being on the minor axis, and at least one insulated cable in at least two of said pockets wherein a ratio of the length of the major axis to the length of the minor axis is from 0.100:0.010 to 0.050:0.030.

8. The communication cable of claim 7 wherein, said major axis is substantially perpendicular to said minor axis, and each of said pockets longitudinally extending substantially parallel to each other.

9. The communication cable of claim 8 wherein, each of said pockets have a cross-sectional area which is 75% or less than a cross-sectional area of a circular envelope of the cable in said pocket.

10. The communication cable of claim 9, wherein a shield surrounds said core and said jacket surrounds the shielded core.

11. The communication cable of claim 8 wherein, said spline has first, second, third, and fourth spaced longitudinally extending open pockets, a cross-section of said spline having a major axis and a minor axis, said first and second pockets having substantially the same cross-sectional area, and said third and fourth pockets having substantially the same cross-sectional area.

12. The communication cable of claim 11, wherein a shield surrounds said core and said jacket surrounds the shielded core.

13. The communication cable of claim 11 wherein, said major axis is substantially perpendicular to said minor axis, said third and fourth pockets having substantially the same cross-sectional area, said first, second, third, and fourth pockets longitudinally extending substantially parallel to each other, a twisted pair cable having a pair of conductors with each conductor having insulation thereon and having a cross-sectional area of a circular envelope and being in each of said pockets, and each of said pockets having a cross-sectional area which is 75% or less than the cross-sectional area of the circular envelope of the twisted pair cable in said pockets.

14. The communication cable of claim 13, wherein a ratio of the length of the major axis to the length of the minor axis is from 0.100:0.010 to 0.050:0.030.

15. The communication cable of claim 13, wherein said first and second pockets having a depth greater than a depth of said third and fourth pockets, and each of said pockets have a cross-sectional area of about 25% to 75% the cross-sectional area of the circular envelope of the cable in said pockets.

16. The communication cable of claim 15, wherein a ratio of the length of the major axis to the length of the minor axis is from 0.100:0.010 to 0.050:0.030.

17. The communication cable of claim 15, wherein a shield surrounds said core and said jacket surrounds the shielded core.

18. The communication cable of claim 17, wherein a ratio of the length of the major axis to the length of the minor axis is from 0.100:0.010 to 0.050:0.030.

19. A communication cable separator spline comprising:

a longitudinally extending spline having a plurality of spaced longitudinally extending open pockets, a cross-section of said spline having a major axis having a length and a minor axis having a length, a ratio of the length of the major axis to the length of the minor axis is from 0.100:0.010 to 0.050:0.030, at least one pocket being on the major axis, and at least one pocket being on the minor axis.

20. The spline of claim 19 wherein, said major axis is substantially perpendicular to said minor axis, each of said pockets longitudinally extending substantially parallel to each other, and each of said pockets have a cross-sectional area which is 75% or less than a cross-sectional area of a circular envelope of a cable to be placed in said pockets.

21. The spline of claim 20, wherein said first and second pockets having a depth greater than a depth of said third and fourth pockets, and each of said pockets have a cross-sectional area of about 25% to 75% the cross-sectional area of the circular envelope of the cable to be placed in said pockets.

22. The spline of claim 19 wherein, said spline has first, second, third, and fourth spaced longitudinally extending open pockets, a cross-section of said spline having a major axis and a minor axis, said first and second pockets having substantially the same cross-sectional area, and said third and fourth pockets having substantially the same cross-sectional area.

* * * * *